US006283678B1

(12) United States Patent
Roberson et al.

(10) Patent No.: US 6,283,678 B1
(45) Date of Patent: Sep. 4, 2001

(54) COMPLIANT OFFSHORE PLATFORM

(75) Inventors: William P. Roberson; Cheng-Yo Chen, both of Houston, TX (US)

(73) Assignee: J. Ray McDermott, S.A., New Orleans, LA (US)

( * ) Notice: Subject to any disclaimer, the term of this patent is extended or adjusted under 35 U.S.C. 154(b) by 0 days.

(21) Appl. No.: 09/490,204

(22) Filed: Jan. 24, 2000

(51) Int. Cl.[7] ..... E02B 17/02
(52) U.S. Cl. ..... 405/224
(58) Field of Search ..... 405/224, 227, 405/195.1, 196, 200, 202

(56) References Cited

U.S. PATENT DOCUMENTS

| | | |
|---|---|---|
| 4,117,690 | 10/1978 | Besse . |
| 4,696,603 | 9/1987 | Danaczko et al. . |
| 4,738,567 | 4/1988 | McGillivray et al. . |
| 4,793,739 | 12/1988 | Hasle et al. . |
| 4,797,034 | 1/1989 | Danguy des Deserts et al. . |
| 5,431,512 | 7/1995 | Haney . |

*Primary Examiner*—Christopher J. Novosad
(74) *Attorney, Agent, or Firm*—D. Neil LaHaye

(57) ABSTRACT

A compliant offshore platform wherein the sole foundation support for platform loads not provided by seawater buoyancy is provided by traditional skirt piles rigidly attached to the platform base near the ocean floor. Lateral flexibility of the platform is enhanced by the introduction of unbraced portal frames located throughout the platform framing in such a way as to facilitate lateral shearing displacements within the platform framing to the extent that the required compliant characteristics are obtained for the sway mode (first structural mode) of vibration while at the same time allowing the overturning moments generated by wind, wave, and current loads to be resisted by the vertical forces within the platform legs and platform foundation. The addition of these portal framed sections at selected locations into an otherwise traditional jacket provides a framing system with improved fundamental modes of vibration as are required for compliant structural behavior. In the preferred embodiment the platform skirt piles are rigidly attached to the jacket near the lowest levels of the jacket framing but somewhat above the seafloor. The skirt piles provide lateral restraint for the base of the platform.

6 Claims, 5 Drawing Sheets

COMPLIANT OFFSHORE PLATFORM

BACKGROUND OF THE INVENTION

1. Field of the Invention

The invention is generally related to bottom-founded offshore platforms and more particularly to such platforms wherein a compliant response to design environmental forces is desirable.

2. General Background

The oil and gas industry has developed a variety of structures, floating vessels, and sub-sea installations to assist with and support drilling and production operations. One of the more common structures used for this purpose is a fixed offshore platform. These platforms have been constructed in an assortment of structural configurations. The term fixed offshore platform in the more general sense is known within the industry to mean any structure founded on the seafloor and extending from the seafloor through the water surface and may support facilities for either drilling and production equipment or both. The portion of the platform housing drilling and production equipment is typically referred to as the platform topsides or deck. The portion of the platform extending from the seafloor through the water surface and supporting the topsides is typically of a type referred to as a jacket (tubular space frame), guyed platform, or tension leg platform. The most common type being the jacket or tubular space frame.

Platforms located in shallow waters are designed for static wind and wave loadings plus dynamic amplification of these loads with little effort directed towards controlling the magnitude of dynamic amplification of these loadings. A platform designed in this manner is generally known within the industry as a 'fixed' or 'non-compliant' platform. Alternatively, the design of the platform may include measures to limit the degree of dynamic amplification of the applied loads. These structures are generally known within the industry as compliant structures. Platform designs include various techniques and means to introduce compliant behavior. The primary objective of a compliant platform is to provide a structure with natural periods of vibration that are substantially different than the period of the waves containing maximum energy within the design wave spectrum. For offshore platforms located in the Gulf of Mexico, the period of vibration to be avoided is typically 13 to 14 seconds. Most compliant structures are configured to have a period of the first mode of vibration (sway mode) in excess of 25 seconds. It is generally desirable for the second mode of vibration (bending mode) to be less than 8 seconds. These values may vary depending on platform location. Platforms with these vibration characteristics avoid design problems associated with resonance and minimize dynamic amplification of the design loads.

Compliant platforms founded on the seafloor and containing a support structure extending from the seafloor to above the water for the support of topside facilities can generally be grouped into one of the two following groups.

The first of these groups consists of several platform designs wherein a sufficiently long period of the first mode of vibration is provided through some form of articulation of a rigidly framed support structure. This articulation may be located at either the platform base or at some intermediate location between the seafloor and the water surface. Some platforms may also include the addition of a mass trap near the top of the structure to assist with obtaining desired first mode periods of vibration.

One such structure is a guyed platform. Guyed platforms are typically supported vertically and laterally at the base while free to rotate out of vertical about the base. Stability is supplied to the platform by an array of guy lines attached towards the platform top and anchored to the seafloor some distance away from the platform base. The platform is restored to a vertical position after being deflected horizontally by tension forces within the attached guys.

Other compliant platforms of this first group include rigidly framed jackets with a point of minimal rotational restraint at either the seafloor or at some intermediate point typically in the lower half of the support structure. Various spring elements, buoyancy, guys, or a combination of these features provide stability and the capacity to return to a vertical position after being deflected laterally. One platform of this type is disclosed in U.S. Pat. No. 4,696,603. Another similar compliant platform of this type was disclosed in the article entitled "Composite Leg Platforms for Deep U.S. Gulf Waters", Ocean Industry, March 1988. The use of a flex pile was disclosed by these designs as one method of providing the required spring characteristics and restoring forces necessary for stability while providing the flexibility required to obtain compliant first mode vibration characteristics. These flex piles are typically rigidly connected to the platform near the platform mid-height and extend into the seafloor or are connected directly to piling extending from the seafloor. At intermediate locations between the seafloor and the upper end of the flex piles, the flex piles pass through guides providing relative axial movement while restraining the flex piles laterally. These guides are necessary to provide shear force transfer between the platform and the foundation and to also increase the compressive buckling strength of the flex piles. These flex piles may be located within the interior of the platform framing or exterior to the platform framing and are generally always framed to the platform legs by guides and an upper rigid connection. Another similar design incorporating a type of flex pile for a compliant concrete structure is disclosed in U.S. Pat. No. 4,793,739.

Also included within this first group of compliant platform structures is a compliant platform disclosed in U.S. Pat. No. 4,797,034 wherein the articulation point is located between a lower platform portion secured to the seafloor and an upper portion supporting the platform topsides. The lower platform section is secured to the seafloor by piling and is without any compliant features. Tubular members secured to both the upper and lower platform section by rigid connections and guides in a manner similar to the flex piles as previously described provide the required flexibility and stability for a compliant structure. Installation considerations will generally dictate that the platform be fabricated in sections different than those delineated by the point of articulation.

A platform disclosed in U.S. Pat. No. 4,738,567 also makes use of a long flexible piling to achieve a period of first mode vibration suitable for a compliant platform. For this platform the flexible pilings are installed through the diameter of large jacket legs. Each leg may contain several piles, which in turn may contain well conductors and casings. Another compliant offshore platform disclosed in U.S. Pat. No. 5,431,512 provides flexible tubular members located within the jacket legs. For this platform each leg contains a single flex tube member which extends beyond the lower end of an upper jacket section leg and is installed into a pre-installed fixed base section secured to the seafloor with piling using conventional offshore methods. These structures provide a compliant platform that pivots at or near the platform base to obtain required sway mode characteristics. The tubular members located within the platform legs provide platform stability and flexibility.

Compliant platforms of this first group achieve compliant characteristics through articulation about the base or at specific locations where hinge devices have been located. The amount of rotation is controlled by the addition of vertical spring elements normally taking the form of elongated vertical tubulars or flex piles. The use of axial flex tubes spanning across the location of a hinge or pivot point as used by some of the disclosed platforms normally requires a platform to pile rigid connection at each end of the axial flex tubes in addition to the normal foundation pile to platform connections. Flex piles as disclosed in U.S. Pat. No. 4,696,603 and the referenced CCLP platform only require one flex pile to platform connection located at the upper end of each flex pile. However, the combined length of foundation pile and the flex pile requires that the pile section below the seafloor be installed prior to platform installation and then spliced with a pre-installed flex pile section extending to the upper flex pile rigid connection. Alternatively it is required that the combined flex pile and foundation pile be spliced during installation and that the rigid flex pile to platform connection be field installed. If the flex piles are not pre-installed on the jacket structure, the location of anodes for cathodic protection from corrosion will be less than optimal. Platforms, which include flex tubes or flex piles require intermediate slip guides each equipped with wear surfaces. Similar wear surfaces are required at corresponding locations on each of the flex tubes or flex piles. Each of these elements increases the complication of the structure and is generally expensive. Typically flex piles, flex tubes, and slip guides are fabricated from materials with higher than normal strength properties. These materials are expensive and may present unnecessary welding difficulties. Non-traditional erection and installation procedures are required for both the hinge elements and flex piles or flex tubes. The concentration of buoyancy provided by pre-installed flex piles can be problematic during the installation launch operation and tends to inhibit design optimization for platform installation.

A second group of compliant platforms consist of structures that are designed to deflect laterally along the length of the structure as opposed to articulation about a designated point or points. These platforms rely on the global shear stiffness properties of the structure to provide a sway mode period of vibration consistent with the requirements of a compliant offshore platform. Internal forces generated by lateral displacement and buoyancy generally provide stability and restoring forces.

The offshore platform disclosed in U.S. Pat. No. 4,117,690 is an example of a compliant platform of the second type. Traditional framing and jacket legs are replaced with large diameter tubulars through which the foundation piling is installed. The platform legs are connected by horizontal framing members at selected levels. The disclosed platform employs a rigid connection between the platform piling and the bottom of the platform legs at the seafloor. These features distinguish the disclosed platform from the first group of structures that provide a point of articulation in order to obtain the required compliant characteristics of the first mode of vibration. The diagonal bracing normally provided within a platform structure to prevent buckling of the platform legs when subjected to compression loads has been eliminated so as to produce a more flexible structure. Local buckling strength of the legs is increased by pile and well conductor guides attached along the inside of the platform legs that serve as longitudinal stiffeners. The disclosed platform also assumes that the platform will be designed to have sufficient buoyancy such that there will exist at least some tension at the bottom of the platform legs. The disclosed platform also provides various techniques and vibration-influencing means in order to achieve compliant characteristics. One such technique is a provision for adjustable ballast compartments located within both braces and legs whereby both the buoyancy and mass of the platform can be varied. Vibration-influencing means such as the use of added stiffness provided by the introduction of X-bracing at selected levels was also disclosed.

The offshore platform disclosed in U.S. Pat. No. 4,117,690 does not require the added components associated with the compliant platforms disclosed in the first group to achieve compliant periods of vibration but does include features which are non-traditional and difficult to construct and maintain over the life of the structure. The extreme lack of diagonal bracing between the platform legs requires the incorporation of features such as the requirement that there be at least some tension at the bottom of the legs and that the legs be large diameter to achieve required buckling strength. The requirement that there be tension at the bottom of the platform legs imposes weight control restrictions and limitations to future platform modifications normally associated with floating structures. The use of ballast compartments throughout the legs and braces imposes costs and risks related to the construction of piping systems, manifolds, and pumps not normally required for conventional platform construction. These features must be maintained throughout the life of the structure. As disclosed in U.S. Pat. No. 4,117,690 stiffeners may be required to provide sufficient local bucking strength to the large diameter legs. The disclosed platform has assumed that the piling will be installed through guides located internally to the legs that will also serve to stiffen the leg's walls. Pile installation through guides attached to the interior of the leg walls may not be practical for any of the platform embodiments that incorporate variable diameter legs. All of the preferred embodiments of the disclosed platform impose further difficulties regarding pile and well string installation through a reduction in leg diameter below the water line. For these conditions platform piles could be pre-driven allowing the platform to be installed by stabbing over pre-driven piles. However, a stab-over procedure would impose fit-up and alignment costs associated with mating to pre-driven piles. All of these pile installation scenarios would incur the risk and uncertainty of completing the rigid connection of the platform leg to the internally located pile without ready access for contingencies. The inclusion of well strings and risers within the platform legs imposes added operational expenses and introduces the hazard of possible explosive gas accumulations within the platform legs.

SUMMARY OF THE INVENTION

Compliant platforms are generally considered as a reasonable alternative for water depths ranging from 1,400 feet to above 2,500 feet. For the deeper water depths, compliant characteristics may be obtained without the need to artificially increase the period of the sway mode of vibration. Considerable effort has been directed towards development of technology to achieve compliant characteristics in platforms installed in the shallower water depths representing a transition between non-compliant and compliant platforms. The present invention has significant advantages for water depths between 1,000 feet and 2,000 feet. The present invention discloses a technology enabling a compliant offshore platform in which the period of the sway mode of vibration is extended by restriction of diagonal bracing at selected locations within the platform framing. Maintaining a diagonally braced jacket structure throughout the majority of the platform height provides stability for the platform. In the preferred embodiments all of the platform foundation support is obtained through a plurality of skirt piles located about the base of the platform. These skirt piles are rigidly connected to the platform base and extend vertically only as necessary to complete the connection at the platform base. The skirt piles may be pre-installed or installed through sleeves attached to the platform framing. The platform supports topsides for drilling and production facilities. The platform framing is conducive to the support of drilling strings, risers, and pull tubes external to the platform legs.

The current invention does not rely on hinges, points of articulation, pivoting devices, vertical spring elements such as flex piles or flex tubes, or components for providing righting forces such as guys or supplemental buoyancy tanks to provide periods of the sway mode of vibration required to obtain compliant behavior. Normal requirements are that the period of the sway mode of vibration be greater than approximately 25 seconds but may vary depending on the environment of the intended platform location. Preferred embodiments of the current invention limit the areas in which unbraced portal framing is substituted for traditional diagonally braced jacket framing to those that are actually required to achieve compliant behavior. Additionally, the current invention does not sacrifice all of the inherent advantages of a totally braced space frame jacket. This feature is useful regarding the installation of piles, well strings, risers, and pull-tubes. The current invention does not require the use of guy lines nor is it required that the platform provide buoyancy to the extent that the platform legs will be loaded in tension. As a consequence of the use of skirt piles rigidly connected near the platform base as opposed to flex piles extending to near mid-platform height, relative motions between the platform base and the seafloor are reduced as is the exposed steel surface area requiring protection from corrosion.

BRIEF DESCRIPTION OF THE DRAWINGS

For a further understanding of the nature and objects of the present invention reference should be made to the following description, taken in conjunction with the accompanying drawings in which like parts are given like reference numerals, and wherein.

DETAILED DESCRIPTION OF THE PREFERRED EMBODIMENT

Figure 1:
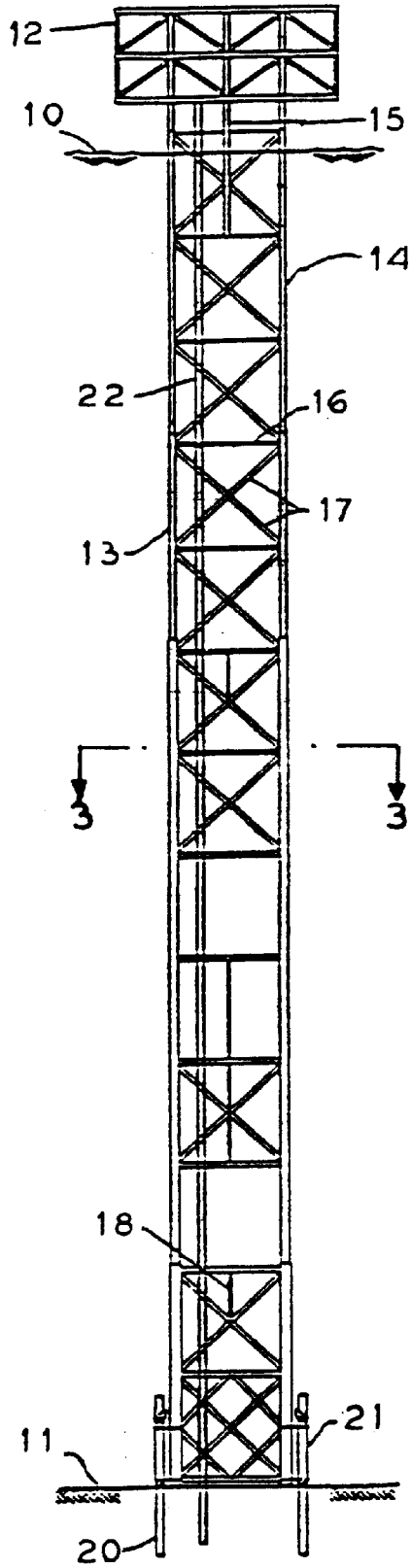
FIG. 1 is an elevation view of a compliant platform according to the present invention.

FIG. 1 illustrates an embodiment of a compliant platform according to the present invention as seen in elevation. The platform jacket 13 is shown to support a deck 12 some distance above the water line 10. The platform jacket 13 extends to a location near the seafloor 11 where it is supported by a plurality of skirt piles 20 rigidly connected to the jacket. These skirt piles are installed through skirt pile sleeves 21 and rigidly connected with the skirt pile sleeves by grouting or by mechanical means, which are well known within the industry. Well conductors 22 normally extend downward from the platform deck 12 into the seafloor 11. Conductor guides 25 (better seen in FIG. 3) are normally provided at each horizontal framing level for lateral conductor support. The jacket legs 14 extend the length of the structure and are normally extended above the water line 10 to support the deck 12. Additional deck support may be provided by false legs 15. Horizontal braces 16, diagonal braces 17, and horizontal diagonal braces 19 (better seen in FIG. 3) interconnect the jacket legs. Additional vertical bracing 18 may be used at various locations to strengthen horizontal braces 16. These components are typically constructed from tubular members and framed together in such a fashion as to form a rigid tubular space frame as is well known within the industry. Typically, platform jackets are constructed in this fashion.

Figure 2:
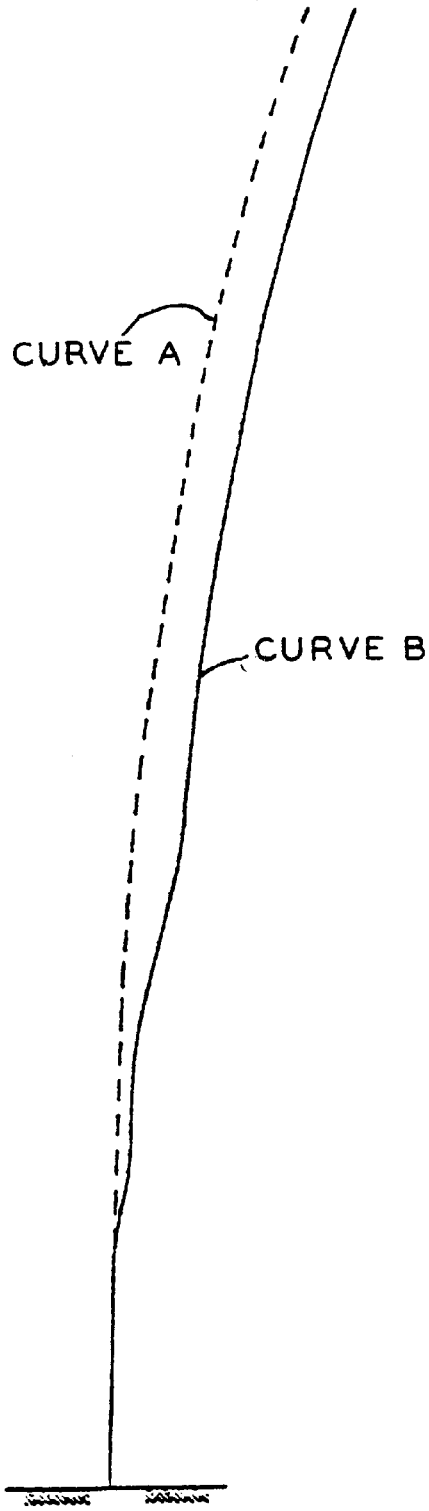
FIG. 2 is a plot of lateral platform displacements illustrating the advantage of the present invention.

In accordance with the present invention, selected areas of the jacket are intentionally left void of any diagonal bracing 17 that traditionally prevents shearing or sway displacements between levels of horizontal bracing 16. This omission of diagonal braces is illustrated to occur at three locations in FIG. 1. This feature of the present invention provides additional flexibility as is required to obtain a period of the sway mode of vibration necessary for compliant response to environmental loadings. This added flexibility can be seen by comparing the two curves of FIG. 2. Curve A depicts the lateral displacement of a traditional, completely braced structure. Curve B depicts the lateral displacement of a platform of the present invention. Shear displacements are introduced at the location of the unbraced jacket levels. These added displacements provide additional flexibility and increase the period of the platform sway mode of vibration. Additional platform leg steel required due to additional leg bending will generally minimize any effects regarding the period of the platform bending mode of vibration. The number and location of unbraced panels is determined by design and is a function of water depth at the site, the weight and mass of the deck, and the environmental forces associated with the platform location.

As is the case for all offshore structures, consideration must be given to seawater pressure on the various tubulars. Likewise, the buoyancy and flotation characteristics of the jacket must be considered for platform installation. These considerations will normally dictate that most of the tubular members remain void and buoyant. However, various installation operations will also necessitate that some of the members be flooded during certain installation sequences. The present invention does not require a particular buoyant configuration once fully installed.

Figure 3:
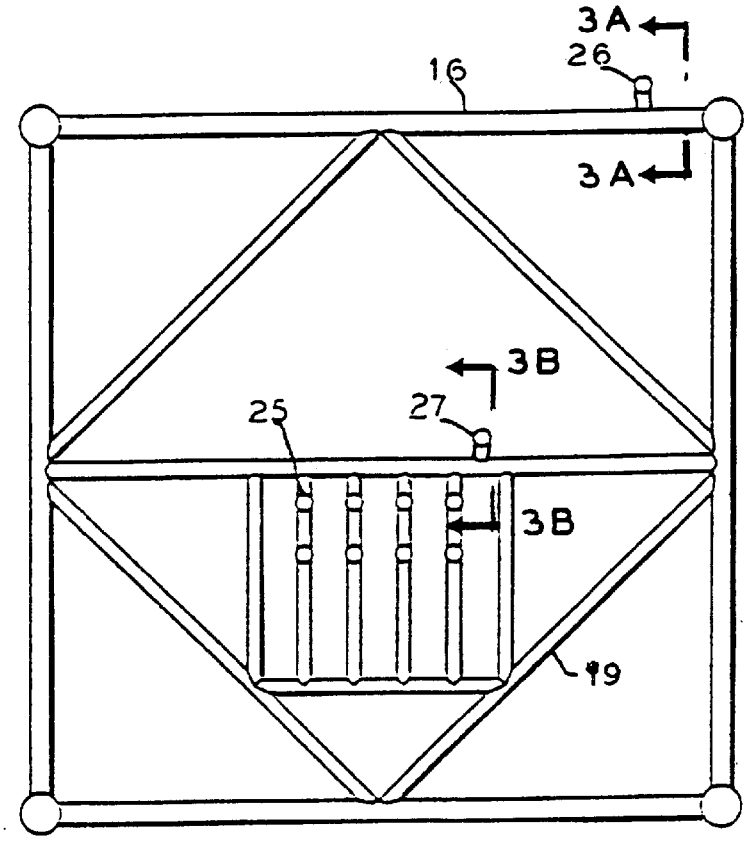
FIG. 3 is a view taken along lines 3—3 in FIG. 1.
Figure 3A:
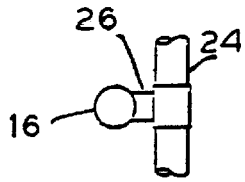
FIG. 3A is a view taken along lines 3A—3A in FIG. 3.
Figure 3B:
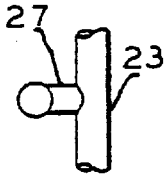
FIG. 3B is a view taken along lines 3B—3B in FIG. 3.

FIG. 3 illustrates typical framing, which may be present within a horizontal plane at each level of horizontal bracing. Horizontal diagonal bracing 19 is provided to prevent racking of the jacket cross-section. These braces also provide support for conductor guides 25, riser supports 26, and pull tube supports 27. These are traditional means of supporting this necessary equipment and are well known within the industry. The present invention may accommodate the typically less desirable placement of these items internal to the platform legs in the event that unusual conditions exist.

Figure 4A:
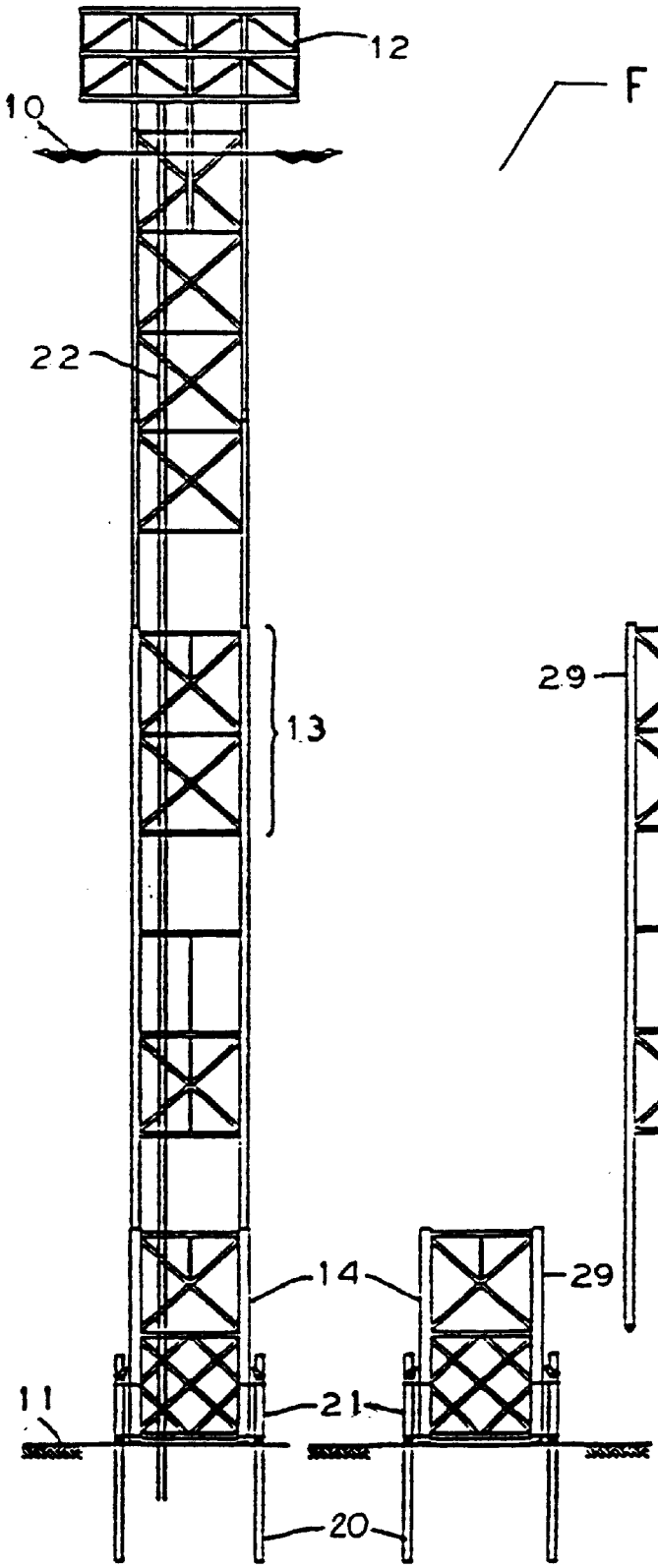
FIGS. 4A and 4B are elevation views of one of the possible installation scenarios.
Figure 4B:
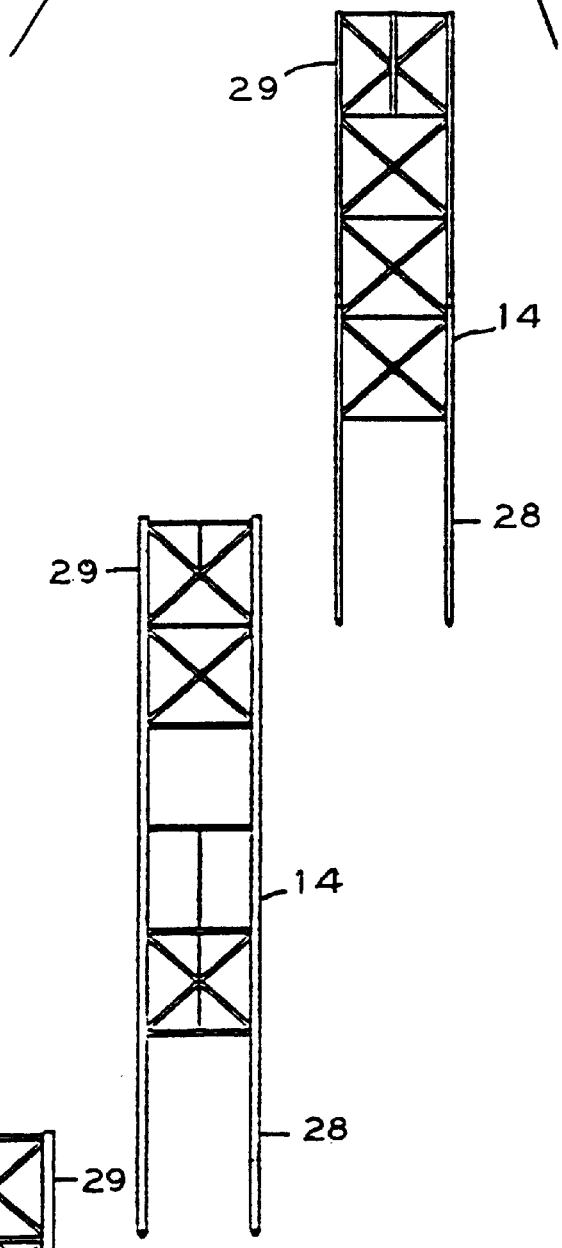

One possible embodiment of the present invention and an associated example installation scenario is illustrated in FIGS. 4A and 4B. An assembled platform including the skirt pile foundation, jacket, and platform deck is shown in FIG. 4A. Because compliant platforms are generally intended for installation at deepwater sites, in excess of one thousand feet, installation by sections is normally desirable. The embodiment shown in FIG. 4B is intended to minimize installation equipment requirements and seeks to also minimize risk from unexpected storms while platform installation is in progress. The initial jacket section is lowered to the seafloor where it is leveled and placed on temporary supports such as mudmats or other temporary supports that are well known within the industry.

Figure 6:
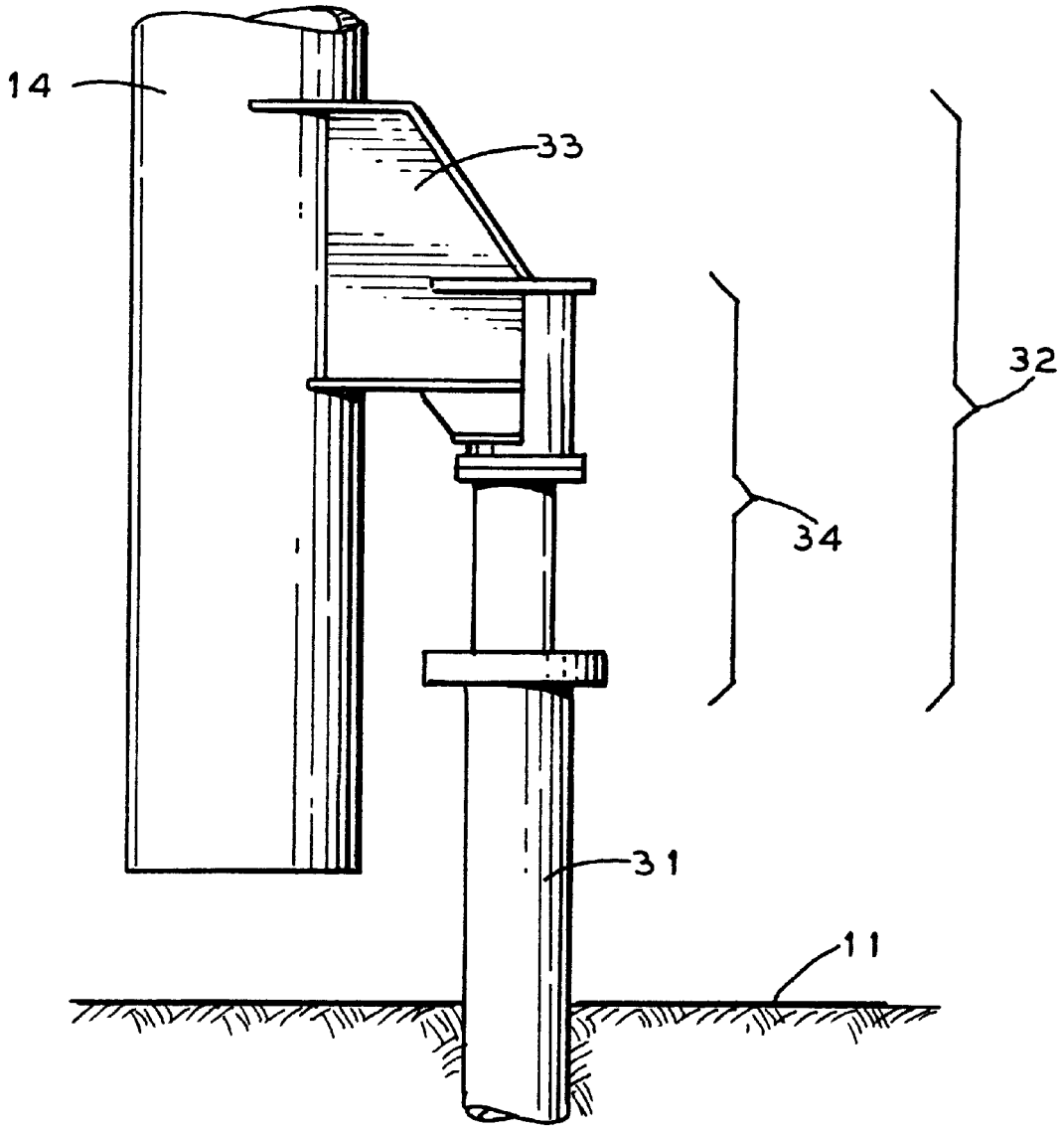
FIG. 6 illustrates means of providing temporary support and leveling of the jacket section.

One such means of providing temporary support and leveling means is illustrated in FIG. 6. The jacket section is brought to rest on temporary support piles 31. Each temporary support pile is engaged by a support bracket assembly 32. The support bracket assemblies 32 are rigidly attached to the jacket leg 14 and all components are of such a capacity as to provide a support interface on which the temporary support piles 31 can bear thereby supporting the weight of the jacket 13 during installation. The support bracket assembly is comprised of a leveling device 34 and a support bracket 33. The support bracket 33 is comprised of a bracket rigidly connected to the jacket leg 14, which in turn supports the leveling device 34. The leveling device 34 provides an interface between the support bracket 33 and the temporary support piles 31 and provides a means of adjusting the landing elevation and thereby the verticality or levelness of the structure. For the example illustrated in the drawings, the leveling device 34 has been shown as a large hydraulic cylinder.

As the initial jacket section is placed on the seafloor, alignment means not shown may be used to locate and stab the jacket over pre-driven wells. Skirt piles are then lowered and driven using conventional methods. Once driven, these skirt piles are rigidly connected to the jacket by grouting or by mechanical means, which are well known in the industry. A second jacket section is then lowered to within close proximity to the previously installed section. Extensions to the lower end of the jacket legs serve as grout pins 28 which are aligned with the upper end of the jacket legs of the previously installed initial jacket section. The legs on the initial jacket section serve as grout sleeves 29. Once aligned, the second jacket section is stabbed into the first section and lowered to a pre-determined elevation where it may be supported on various permanent or temporary support devices. The jacket sections are then aligned vertically and rigidly connected by grouting or mechanical means. This procedure is then repeated with additional jacket sections until the complete platform has been installed. At this point, the platform deck 12 is installed on the jacket support structure. The number of unbraced jacket panels, the number of jacket sections, and the lengths of the various jacket sections will vary depending on the particular requirements of a given platform. It is not necessary that the areas of the jacket where the diagonal bracing is excluded be located adjacent to the rigid connections between jacket sections. Each of the connections between jacket sections are configured as grouted connections wherein the grout pins 28 extend downward and are received by grout sleeves 29 located in a lower jacket section. The position of the pins may be reversed wherein the grout pins extend upward from a lower jacket section and are received by grout sleeves located at the lower end of legs of the adjacent upper jacket section. Further, it is understood that the grouted connection may extend for a length less than the distance between horizontal bracing levels and may also extend across a plurality of horizontal bracing levels and in effect form a composite member in addition to providing a rigid connection between platform sections.

Figure 5A:
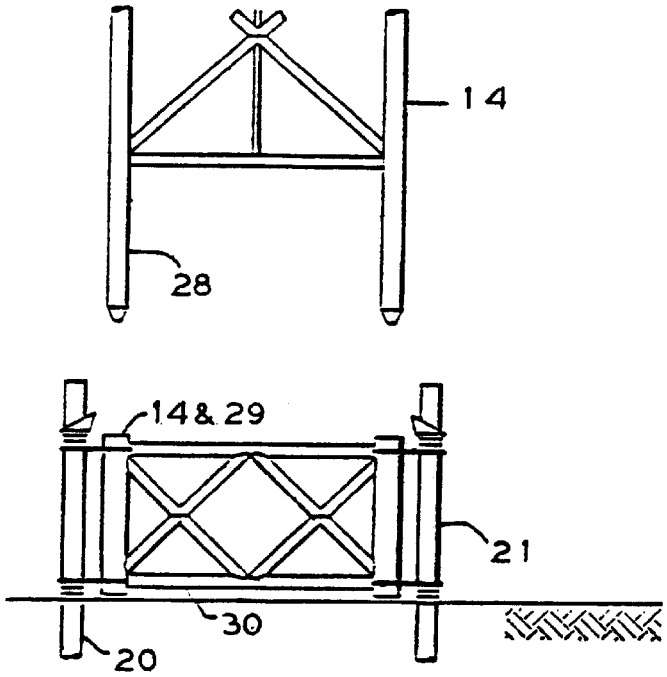
FIGS. 5A and 5B are elevation views near the platform base wherein the foundation piles are installed taking advantage of a shallow platform base section utilized as a template.
Figure 5B:
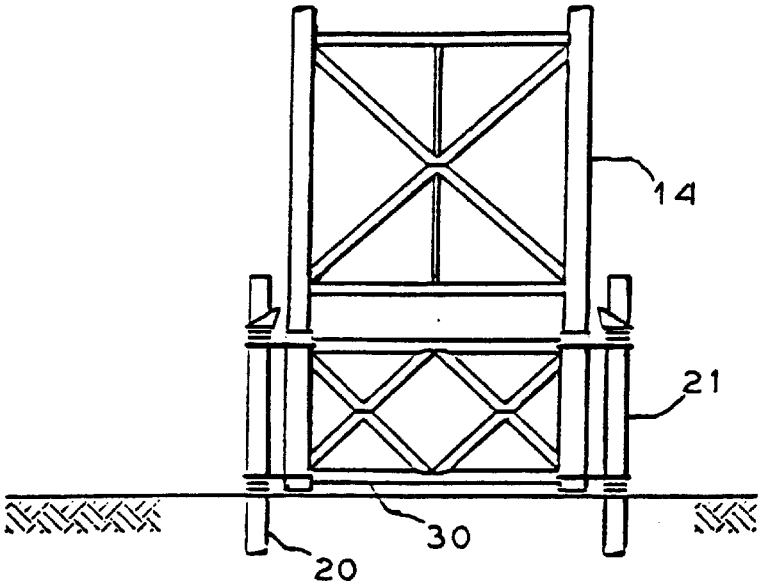

FIG. 5 illustrates an additional embodiment of the invention wherein a truncated section of the jacket is installed and functions as an installation template 30. The use of a template 30 may be beneficial for a variety of reasons related to conductor installation, pre-drilling of wells, or pre-driving of skirt piles. The template section 30 is lowered to the seafloor where it is leveled and placed on temporary supports such as mudmats or other temporary supports that are well known within the industry. As the template section is placed on the seafloor, alignment means not shown may be used to locate and stab the template over pre-driven wells. Skirt piles are then lowered and driven using conventional methods. Once driven, these skirt piles are rigidly connected to the jacket by grouting or mechanical means well known within the industry. At this point well conductors may be pre-installed and initial drilling may be commenced with the use of a floating drilling vessel. The remainder of the platform may then be installed at some later time as described above and illustrated in FIG. 4. These procedures offer the advantage that an early installation of the platform foundation, installation of conductors, and pre-drilling of wells may be accomplished while the design and fabrication of the remainder of the platform and platform deck is being completed. The capacity of the foundation piles will benefit from the additional set-up period provided between actual driving of piles and completion of the platform.

There are several advantages to the present invention, which include, but are not limited to, all the advantages of compliant platforms in general when compared to non-compliant platforms. Of primary importance is the ability to produce oil and gas in the dry using above-water manned faculties based on a bottom-founded platform in water depths beyond those that are economical for non-compliant platforms. The present invention does not rely on hinges or pivoting devices. It is not necessary that the installed platform be positively buoyant. The present invention does not require that the platform foundation piles, well strings, or risers be installed internally to the platform legs. Avoiding the installation of well strings and risers through the interior of the platform legs eliminates the hazard associated with gas accumulations inside platform legs.

All of the platform foundation piles may be traditional skirt piles taking advantage of existing pile installation technology. This existing technology includes the use of grouting hardware such as pile grippers and grout seals. Skirt piles as described in the various embodiments of the present invention only require one pile to platform connection for each pile. The use of skirt piles rigidly connected to the platform as disclosed in the present invention eliminates the requirement for intermediate flex pile guides, the additional framing required to integrate the flex pile guides into the platform, and eliminates the need for slip guides and wear surfaces on either the piles or guides. Installation and fabrication complications associated with the use of a hinge within the platform jacket are eliminated. The present invention eliminates the problems sometimes associated with the sudden addition of buoyancy as pre-installed flex piles or axial flex tubes initially enter the water during platform launch. The elimination of flex piles or axial tubes from the structure significantly reduces the exposed surface area that must be protected from corrosion. The method of obtaining the required vibration characteristics necessary to obtain compliant behavior as disclosed in the present invention facilitates the inclusion of structural support for well strings, j-tubes and risers as in traditional jackets. The rigid connection of the platform piles near the base of the platform serves to reduce relative displacements between the platform and the seafloor when compared to prior art platform designs employing flex piles that are secured to the platform near mid-platform. These reduced relative displacements are beneficial to the design of well strings, risers, and pull-tubes. Additionally, since the base of the platform is rigidly connected to the foundation piles and since the present invention does not rely on large displacements and rotations about the base for compliant behavior, it is not necessary to decouple the jacket from temporary installation supports after platform installation.

Because many varying and differing embodiments may be made within the scope of the inventive concept herein taught and because many modifications may be made in the embodiment herein detailed in accordance with the descriptive requirement of the law, it is to be understood that the details herein are to be interpreted as illustrative and not in a limiting sense.

What is claimed as invention is:

1. A compliant offshore platform, comprising:

a. a platform topsides;

b. a structural framework supporting said topsides, said structural framework having at least three support legs extending from said topsides downward to a point approximately above the seafloor;

c. said structural framework containing appurtenances used for the production of oil and gas;

d. the support leg interiors being free of any additional support;

e. said platform support structure may have a fixed buoyancy and mass and may be negatively buoyant;

f. the support legs being supported by skirt piles rigidly connected to the support legs near the seafloor; and g. the support legs being braced horizontally and diagonally, with limited portions of the structural framework remaining unbraced at one or more locations along the length of the structural framework.

2. The platform of claim 1, wherein the platform is free of any components for the purpose of providing hinges, points of articulation, vertical spring elements, or components for providing righting forces such as guys or supplemental buoyancy tanks.

3. The platform of claim 1, wherein said structural framework is installed in at least two sections.

4. The platform of claim 3, wherein the lower structural framework section extends vertically only a sufficient height to act as a guide or template for pile installation and contains the pile to platform rigid connections.

5. The platform of claim 3, wherein said structural framework sections include means to achieve a substantially vertical platform installation.

6. The platform of claim 1, wherein the platform skirt piles are pre-driven.

* * * * *